United States Patent [19]

Rauline

[11] Patent Number: 4,564,467

[45] Date of Patent: Jan. 14, 1986

[54] OIL COMPOSITION

[75] Inventor: Alain J. Rauline, Pavilly, France

[73] Assignee: Exxon Research and Engineering Co., Florham Park, N.J.

[21] Appl. No.: 566,203

[22] Filed: Dec. 28, 1983

[30] Foreign Application Priority Data

Dec. 31, 1982 [GB] United Kingdom ..... 8237073

[51] Int. Cl.[4] ..... H01B 3/22; H01B 3/46

[52] U.S. Cl. ..... 252/573; 252/78.3; 252/49.6; 556/450; 556/465; 585/6.3; 585/6.6

[58] Field of Search ..... 252/78.3, 49.6, 573; 585/6.3, 6.6; 556/450, 465

[56] References Cited

U.S. PATENT DOCUMENTS

| | | | |
|---|---|---|---|
| 2,911,369 | 11/1959 | Zajac et al. | 252/49.6 |
| 3,632,619 | 1/1972 | Groenhof | 556/453 |
| 3,671,433 | 6/1972 | Brenner | 252/78.3 |
| 3,833,408 | 9/1974 | Matthies | 252/49.6 |
| 4,059,534 | 11/1977 | Morro et al. | 252/78.3 |

FOREIGN PATENT DOCUMENTS

| | | |
|---|---|---|
| 1476657 | 6/1967 | United Kingdom . |
| 1208022 | 10/1970 | United Kingdom . |

*Primary Examiner*—Paul Lieberman
*Assistant Examiner*—Robert A. Wax
*Attorney, Agent, or Firm*—Eugene Zagarella; Edward H. Mazer

[57] ABSTRACT

This invention concerns an oil composition comprising a major proportion by weight of an oil having a kinematic viscosity of 5 to 30 cSt at 40° C. e.g. a transformer oil, and a minor proportion by weight of an organo siloxane having the formula:

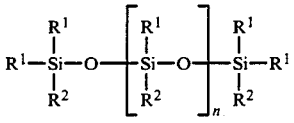

wherein $R^1$ is independently methyl, ethyl or propyl, $R^2$ is independently a $C_{10}$ to $C_{20}$ alkyl group and n is 12 to 28.

Such oil compositions having low pour points and excellent dielectric properties can be used as electrical oils.

11 Claims, No Drawings

OIL COMPOSITION

This invention relates to oil compositions containing a silicone oil additive.

The low temperature properties e.g. pour point, of light industrial oils are improved by the addition of certain additives. At the moment light base oils for use as electrical oils have their pour point depressed by the addition of nonpolar additives based on hydrocarbon polymers. We have now found certain selected organo siloxanes which surprisingly give good pour point depression when added to light mineral oils. The organo siloxanes have very low polarity and show excellent dielectric properties making them suitable for application in electrical oils. Furthermore these organo siloxanes do not modify the physico-chemical characteristics of the base oil such as when other additives are used. These other additives can degrade properties such as interfacial tension and cause dielectric losses which are critical parameters for insulating oils.

According to this invention an oil composition comprises a major proportion by weight of an oil having a kinematic viscosity of 5 to 30 cSt at 40° C. and a minor proportion by weight of an organo siloxane having the formula:

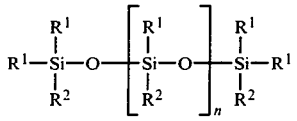

wherein $R^1$ is independently methyl, ethyl or propyl, $R^2$ is independently a $C_{10}$ to $C_{20}$ alkyl group and n is 12 to 28.

The oil is usually a mineral oil of electrical grade or of insulating grade. Thus the oil may be a straight mineral lubricating oil or a distillate derived from paraffinic naphthenic, asphaltic or mixed base crudes. Alternatively, the oil may be an extracted oil produced for example by solvent extraction with a solvent such as phenol, sulphur dioxide, furfural, dichlorodiethyl ether, nitro benzene or crotonaldehyde.

A mineral oil particularly suitable as an electrical oil comprises one prepared by refining petroleum distillates by various processes, the most usual of which is treatment by a selective solvent such as phenol or furfural to remove at least some of the aromatic compounds, dewaxing treatment by solvent dewaxing (the solvent being for example propane, dichloro methane, ketones: methyl ethyl ketone/methyl isobutyl ketone, methyl ethyl ketone/toluene) or urea dewaxing or treatment by an activated earth and/or hydrogenation.

60 Neutral grade oil a solvent refined, solvent dewaxed, hydrofined petroleum distillate, is also particularly suitable for use in transformer oil compositions (viscosity at 40° C.=8 cSt, flash point ≧140° C.). Also 90 Neutral base oils solvent refined, solvent dewaxed, hydrofined petroleum distillates, (viscosity at 40° C.≃20 cSt) can also be used.

The oil has to have a kinematic viscosity of between 5 and 30 cSt at 40° C. and a viscosity of between 5 and 20 cSt at 40° C. is preferred.

In the organo siloxane having the formula:

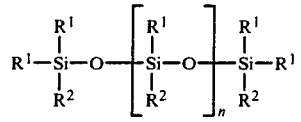

preferably at least 50% of the $R^1$ alkyl groups are methyl. Preferably each $R^2$ alkyl group is independently a $C_{14}$, $C_{15}$ or $C_{16}$ alkyl group, especially $C_{14}$, $C_{15}$ or $C_{16}$ straight chain alkyl groups. It is also preferred that n ranges from 16 to 22, more preferably 18 to 20, e.g. 20.

A particularly preferred organo siloxane is one having the formula:

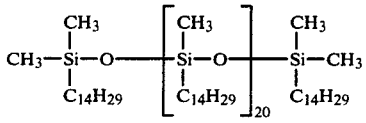

The amount of organo siloxane added to the oil can vary provided it is a minor proportion by weight. In practice the proportion should be 0.01 to 10.0 wt %, preferably 0.01 to 5 wt.%, e.g. about 0.1 wt % based on the total weight of oil.

It is not usually necessary to add other additives, but if desired small quantities, e.g. 0.01 to 2 wt % based on the oil, of phenolic or amine type antioxidants could be added for transformer oil applications. If the compositions of the invention are used for other applications conventional additives may be added.

Not only is it found that the oil compositions of this invention show a much reduced pour point compared with the oil alone, but it is found that the oxidation stability is slightly improved compared with the oil alone.

In the following Examples the organo siloxane additive which was used was one having the formula:

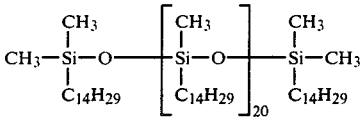

EXAMPLE 1

The organo siloxane additive was added at different rates to a solvent-extracted, solvent dewaxed and hydrofined transformer base oil and the pour point measured. The transformer base oil had a kinematic viscosity at 40° C. of 8 cSt, an aromatic carbon content (by infra-red) of 14%, a natural pour point of −27° C., a flash point ≧140° C. and a sulphur content of 0.35 wt %. The pour points obtained after the addition of various quantities of additive were as follows:

| Treat rate (%) | Pour Point (°C.) |
|---|---|
| (0) | (−27) |
| 0.05 | −39 |
| 0.10 | −45/−48 |
| 0.50 | −54 |

EXAMPLE 2

In this Example the same organo siloxane additive (Additive A) was added to the same transformer base oil as in Example 1. For comparison purposes tests were also carried out using a conventional pour point depressant, a styrene-butadiene copolymer (Additive B). The oxidation stability of the resulting composition was also tested by the Baader Oxidation Test.

| | Transformer Oil alone | Transformer Oil + 0.5 wt % Add. B | Transformer Oil + 0.1 wt % Add. A |
|---|---|---|---|
| Pour Point (°C.) | −24 | −48 | −48 |
| Baader Oxidation Test | | | |
| Sludge (mass %) | 0.012 | 0.02 | 0.019 |
| Saponification No. (mg KOH/g) | 0.15 | 0.17 | 0.17 |
| Tan Δ (%) | 1.65 | 1.8 | 1.7 |
| Pour point after Baader test (°C.) | — | −48 | −48 |

Thus it can be seen that the additive of the invention gives comparable results as those shown by additive B, but with treat rates of only 20% that for additive B.

EXAMPLE 3

Additive A was added to various light oils at treat rates of 0.1% and 0.3% by weight based on the weight of oil and the pour points measured. All the oils were solvent-refined and solvent-dewaxed oils. The results were as follows:

| Viscosity Grade | 60 N transformer oil | 90 N | 130 N | 175 N |
|---|---|---|---|---|
| Kinematic Viscosity of oil (C.St at 40° C.) | 8 | 18 | 25 | 35 |
| 0.1% Add. A Δ Pour point (°C.) | −15 | −15 | 0 | 0 |
| 0.3% Add A Δ Pour point (°C.) | −15/−18 | −15 | −12 | 0 |

Thus, it can be seen that no noticeable reduction in pour point is achieved with oils having kinematic viscosities of 35 cSt at 40° C.

What is claimed is:

1. An electrical oil composition having suitable dielectric properties comprising a major proportion by weight of an oil having a kinematic viscosity of 5 to 30 cSt at 40° C. and a pour point depressing amount in the range of 0.01 to 10.0 weight percent of an organo siloxane having the formula:

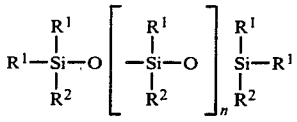

wherein $R^1$ is independently methyl, ethyl or propyl, $R^2$ is independently a $C_{10}$ to $C_{20}$ alkyl group and n is 12 to 28.

2. A composition according to claim 1 wherein the oil is a mineral oil of electrical grade.

3. A composition according to claim 2 wherein the oil is 90 Neutral base oil or transformer oil 60N.

4. A composition according to claim 1 wherein the kinematic viscosity of the oil at 40° C. is between 5 and 20 cSt.

5. An electrical oil composition having suitable dielectric properties comprising a major proportion by weight of an oil having a kinematic viscosity of 5 to 30 cSt at 40° C. and a pour depressing amount in the range of 0.01 to 10.0 weight percent of an organo siloxane having the formula:

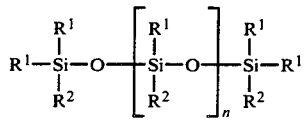

wherein $R^1$ is independently methyl, ethyl or propyl, $R^2$ is independently a $C_{14}$, $C_{15}$ or $C_{16}$ alkyl group and n is 12 to 28.

6. A composition according to claim 5 wherein the oil is a mineral oil of electrical grade.

7. A composition according to claim 6 wherein the oil is 90 Neutral base oil or transformer oil 60N.

8. A composition according to claim 5 wherein the kinematic viscosity of the oil at 40° C. is between 5 and 20 cSt.

9. An electrical oil composition having suitable dielectric properties comprising a major proportion by weight of an oil having a kinematic viscosity of 5 to 30 cSt at 40° C. and a pour depressing amount in the range of 0.01 to 10.0 weight percent of an organo siloxane having the formula:

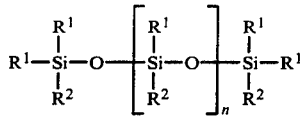

wherein $R^1$ is independently methyl, ethyl or propyl, $R^2$ is independently a $C_{10}$ to $C_{20}$ alkyl group and n is 16 to 20.

10. A composition according to claim 9 wherein the kinematic viscosity of the oil at 40° C. is between 5 and 20 cSt.

11. A composition according to claim 9 wherein the organo siloxane has the formula:

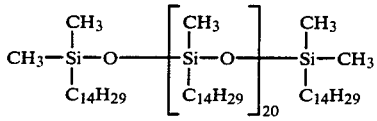

* * * * *